US006848861B2

(12) United States Patent
Dreyer

(10) Patent No.: US 6,848,861 B2
(45) Date of Patent: Feb. 1, 2005

(54) Y-PANEL ANCHORING SYSTEM FOR BOOM INSTALLATION

(75) Inventor: Harold B. Dreyer, Anchorage, AK (US)

(73) Assignee: Gunderboom, Inc., Anchorage, AK (US)

( * ) Notice: Subject to any disclaimer, the term of this patent is extended or adjusted under 35 U.S.C. 154(b) by 0 days.

(21) Appl. No.: 10/134,359

(22) Filed: Apr. 26, 2002

(65) Prior Publication Data

US 2002/0172560 A1 Nov. 21, 2002

Related U.S. Application Data

(60) Provisional application No. 60/286,504, filed on Apr. 26, 2001.

(51) Int. Cl.[7] ..... E02B 15/06
(52) U.S. Cl. ..... 405/63; 405/70
(58) Field of Search ..... 405/63, 64, 66, 405/70, 72

(56) References Cited

U.S. PATENT DOCUMENTS

| | | | | |
|---|---|---|---|---|
| 1,397,891 A | | 11/1921 | Jones | |
| 3,456,265 A | * | 7/1969 | Carnahan | 405/63 |
| 3,548,599 A | | 12/1970 | Reilly | |
| 3,744,253 A | * | 7/1973 | Williams et al. | 405/66 |
| 3,783,621 A | * | 1/1974 | Preus et al. | 405/63 |
| 3,818,708 A | | 6/1974 | Benson | |
| 4,244,819 A | | 1/1981 | Ballu | |
| 5,071,286 A | * | 12/1991 | Separovich | 405/66 |
| 5,102,261 A | | 4/1992 | Gunderson, III | |
| 5,553,972 A | | 9/1996 | Bergerson et al. | |
| 6,346,193 B1 | * | 2/2002 | Bauer | 405/52 |

FOREIGN PATENT DOCUMENTS

| | | |
|---|---|---|
| WO | WO 99/19570 | 4/1999 |

* cited by examiner

*Primary Examiner*—Michael Safavi
(74) *Attorney, Agent, or Firm*—Nixon Peabody LLP

(57) ABSTRACT

The present invention relates to an anchoring system for a containment/exclusion boom, the anchoring system including: a Y-panel member which is adapted to be connected to a curtain of a containment/exclusion boom, said Y-panel member comprising a first skirt panel and a second skirt panel each having their proximal ends joined together and each having a distal end; and means for maintaining the distal ends of the first and second skirt panels substantially against the floor of a body of water upon introduction of the anchoring system into the body of water. Also disclosed are a containment/exclusion boom which includes an anchoring system of the present invention and a method of containing/excluding contaminants from passage from one side to another side of a boom through the use thereof.

12 Claims, 5 Drawing Sheets

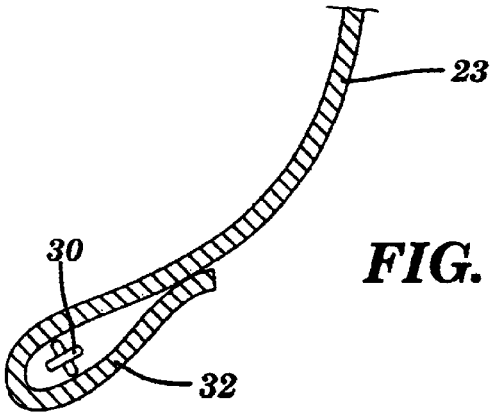
FIG. 6A
FIG. 6B
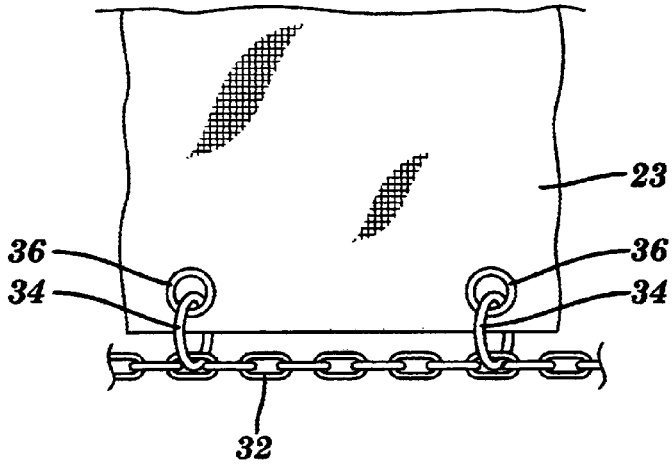
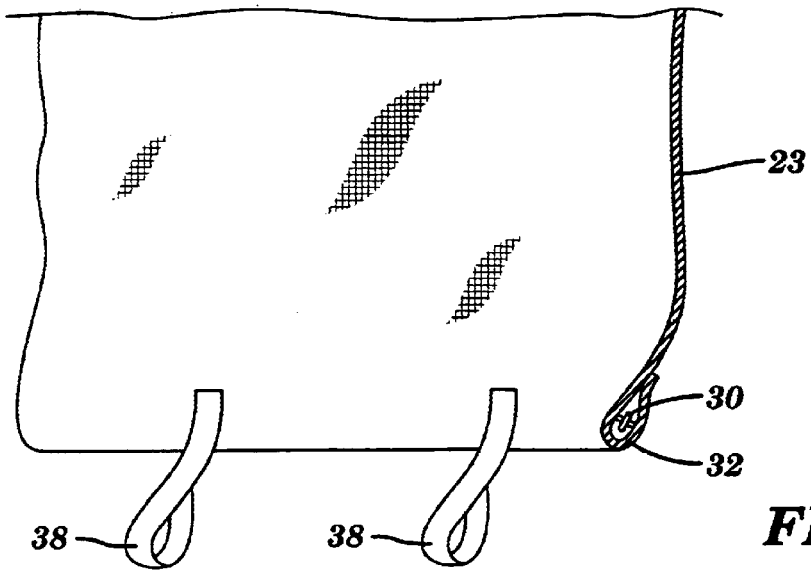
FIG. 6C

Y-PANEL ANCHORING SYSTEM FOR BOOM INSTALLATION

This application claims the priority benefit of U.S. Provisional Patent Application Ser. No. 60/286,504 filed Apr. 26, 2001, which is hereby incorporated by reference in its entirety.

FIELD OF THE INVENTION

The present invention relates generally to containment/exclusion booms and their use to control movement of contaminants in bodies of water. More specifically, the present invention relates to an anchoring system for use on such booms.

BACKGROUND OF THE INVENTION

Containment/exclusion booms can be used to filter water or restrict the flow of contaminants from one side of the boom to the other. Such contaminants can include any debris or marine life, as well as silt which is laden with bacteria. Unfortunately, while such use of the containment/exclusion boom can be effective in reducing the debris, marine life, or silt in the water on one side of the boom, many such booms have a tendency to shift position in response to tidal action, or in response to increasing or decreasing water pressure (which may occur for a variety of reasons) on either side of the boom. This change in position can cause seepage of contaminants (e.g., debris, marine life, or silt) under the lower edge of the main boom curtain.

It would be desirable, therefore, to provide a containment/exclusion boom with an anchoring mechanism which would allow for the maintenance of a seal which prevents or at least substantially minimizes the movement of contaminants in either direction under the boom.

It would also be desirable to make it possible to secure the boom in a fixed position to counteract tidal action or changes in water pressures and levels on either of the boom curtain.

The present invention is directed to achieve these objectives and others, as well as overcome these and other deficiencies in the art.

SUMMARY OF THE INVENTION

A first aspect of the present invention relates to an anchoring system for a containment/exclusion boom, the anchoring system including: a Y-panel member which is adapted to be connected to a curtain of a containment/exclusion boom, said Y-panel member including a first skirt panel and a second skirt panel each having their proximal ends joined together and each having a distal end; and means for maintaining the distal end of the first and second skirt panels substantially against the floor of a body of water upon introduction of the anchoring system into the body of water.

A second aspect of the present invention relates to a containment/exclusion boom which includes: a support system which can be positioned in a body of water; an upper curtain member made of a flexible fabric that allows movement of water therethrough, said upper curtain member being connected to said support system; a Y-panel member integral with or connected to said upper curtain member, said Y-panel member including a first skirt panel and a second skirt panel each having a proximal end adjacent the upper curtain member and each having a distal end; and means for maintaining the distal ends of the first and second skirt panels substantially against the floor of a body of water upon introduction of the containment/exclusion boom into the body of water.

A third aspect of the present invention relates to a method of containing/excluding contaminants from passage from one side to another side of a boom which includes: installing a boom of the present invention into a body of water with the first skirt panel maintained on the floor of the body of water substantially on one side of the upper curtain member and the second skirt panel maintained on the floor of the body of water substantially on the other side of the upper curtain member, wherein one or both of the first and second skirt panels are maintained substantially against the floor of the body of water, thereby containing or excluding contaminants from passage from one side to another side of the boom.

The inclusion of the Y-panel member secured to the lower edge of the main boom curtain, along with suitable anchors or ballast, affords better control of contaminant movement, i.e., over substantially the entire water column. Booms according to the invention can be used to contain contaminants, including oil spills, suspended particulates, and other lighter-than-water releases, as well as silt, debris, and marine life. The Y-panel skirts provide for a much tighter seal against the movement of contaminants underneath the lower edge of the boom and makes it possible to secure the boom in a fixed position when needed for a specific application. Moreover, the Y-panel skirts afford enhanced containment even following changes in tidal conditions or changes in water pressures on the opposite sides of the boom.

The boom system can be deployed from a barge, a dock with a small boat, or other surface or access point near the water. The invention is uncomplicated in design and can be easily deployed by persons having basic waterfront experience without prior training in containment boom deployment.

BRIEF DESCRIPTION OF THE DRAWINGS

In FIG. 5A, the two skirts which form the Y-panel member are each connected directly to the lower edge of the upper curtain member. In FIG. 5B, only one skirt is connected directly to the lower edge of the upper curtain member; the other skirt is connected indirectly to the lower edge of the upper curtain member via the first skirt. In FIG. 5C, both skirts are connected directly to a connector panel, which is provided with a connector designed for mating engagement with a corresponding connector on the lower edge of the upper curtain member.

FIGS. 6A–C illustrate different techniques for connecting the distal ends of the skirts to ballast or anchors. In FIG. 6A, the distal end of a skirt is folded and secured to itself to form a sleeve in which ballast (e.g., chain) is provided. In FIG. 6B, the distal end of a skirt is provided with a series of grommets which receive connectors that attach to ballast (e.g., chain). In FIG. 6C, the distal end of a skirt is provided with straps that can be used to connect the distal end to chain or lines leading to anchors as shown in FIG. 1.

DETAILED DESCRIPTION OF THE INVENTION

The present invention relates to a Y-panel member used in an anchoring system for a containment/exclusion boom of the present invention. The Y-panel member itself can be integrally formed with the curtain of a containment/exclusion boom or separately prepared and connected thereto as described herein.

The Y-panel member includes a first skirt panel and a second skirt panel, each having their proximal ends joined together and each having a distal end. The proximal ends of the skirts are intended to be connected to and/or integrally formed with an upper curtain member which forms the majority of the boom curtain.

Figure 1:
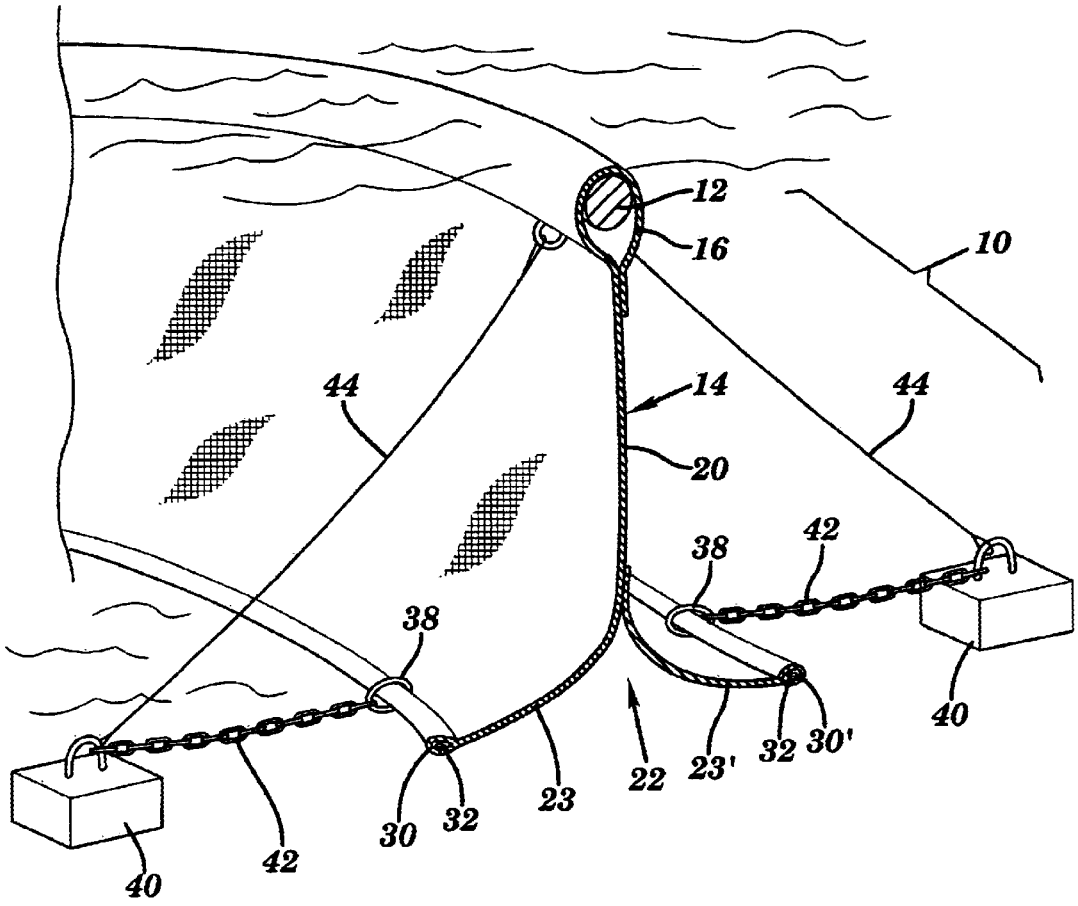
FIG. 1 is a perspective view of a boom of the present invention which is installed into a body of water. As shown in this embodiment, the Y-panel member is integrally formed with the upper curtain member, whereby one of the skirts is simply formed by the lower end of the upper curtain member and the other skirt is attached to the upper curtain member.

Referring now to FIG. 1, the invention is embodied in a containment/exclusion boom 10 which includes a flotation unit 12 and an upper curtain member 14. The curtain member 14 has an upper sleeve 16 and a main sheet portion 20. The sleeve 16 is constructed by folding an upper edge portion of the material along a lengthwise fold line and securing the upper edge portion to the main sheet portion 20, e.g., by sewing, heat fusion, etc. The flotation unit 12, which may comprise one or more lengths of buoyant material, can then be inserted, when desired, into vertical slits cut in the upper sleeve 16 at predetermined intervals. Alternatively, the upper edge portion of the curtain member 14 can be folded around the flotation unit 12 and then secured to the main sheet portion 20, forming the upper sleeve 16 with the flotation unit 12 therein. If an inflatable flotation unit is used, the upper sleeve 16 may additionally be provided with inlets/outlets for valves used to inflate and deflate the flotation unit.

The lower edge of the curtain member 14 has integrally formed therewith and/or connected thereto a Y-panel member 22. The Y-panel member 22 includes a pair of skirt panels 23,23' and optionally a connector panel 24.

In FIG. 1, the Y-panel member 22 is shown integrally formed with the upper curtain member 14, whereby one of the skirts 23 is simply formed by the lower end of the upper curtain member and the other skirt 23' is attached to the upper curtain member.

Figure 5A:
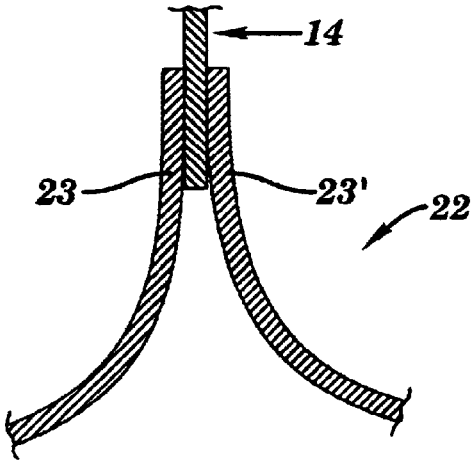
FIGS. 5A–C illustrate different embodiments for connecting the Y-panel member to the upper curtain member.
Figure 5B:
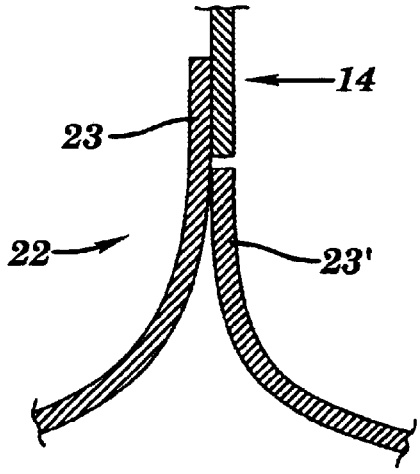
Figure 5C:
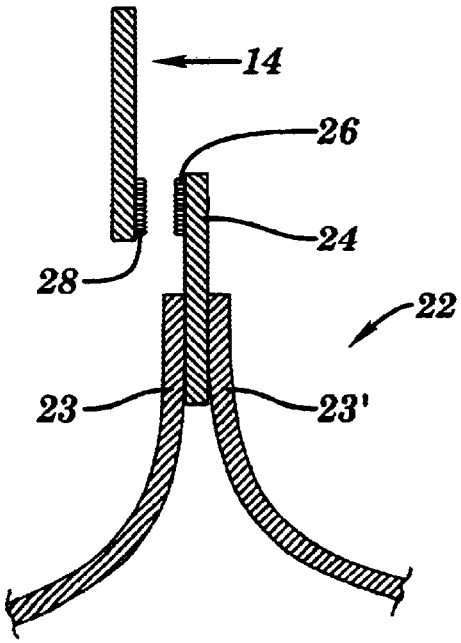

In FIG. 5A, the Y-panel member 22 is shown with the proximal ends of both skirts 23,23' connected directly to the lower edge of the upper curtain member 14. In FIG. 5B, only one skirt 23 is connected directly to the lower edge of the upper curtain member 14; the other skirt 23' is connected indirectly to the lower edge of the upper curtain member 14 via the first skirt 23. In FIG. 5C, both skirts 23,23' are connected directly to the connector panel 24, which is provided with a connector 26 designed for mating engagement with a corresponding connector 28 on the lower edge of the upper curtain member 14. Connectors 26 and 28 can be any suitable connectors, e.g., hook and loop type fasteners.

The skirts 23,23', connector panel 24, and upper curtain member 14 can be attached together by any appropriate means, such as zipper connections, heat sealing, sewing, couplers, etc.

Referring now to FIGS. 1 and 6A–C, the distal ends of the skirts can be coupled with ballast or anchoring devices for purposes of maintaining the distal ends of the first and second skirts 23,23' substantially against the floor of a body of water (i.e., upon introduction of the containment/exclusion boom into the body of water). As shown in FIG. 1 and FIG. 6A, the distal ends of the skirts 23,23' can be finished by folding along a lengthwise fold line and securing the ends to the body of the skirt, e.g., by sewing, heat fusion, etc., thereby forming sleeves 30,30'.

Ballast 32 such as lengths of steel chain (from less than ⅛ inch to over ¾ inch) or steel cable (from less than ¾ inch to over 1½ inches in diameter) have been used inside sleeves 30,30'. Of course, chains and cables of greater or less diameter may be used to meet the specific requirements of a project design. It is not always necessary to form the sleeves 30,30' on the first and second skirts 23,23' to contain ballast. As shown in FIG. 6B, ballast 32 can be tied with connector 34 (e.g., corrosive resistant wire connector) which passes through grommets 36 formed at the distal ends of skirts 23,23'.

In addition, as shown in FIG. 6C, a skirt 23,23' of the type illustrated in FIG. 6A can also include straps 38 connected (e.g., by heat sealing, sewing, etc.) adjacent the distal ends thereof for purposes of connecting the distal ends to cables or chains 42 which attach at their opposite ends to anchors 40 (both shown in FIG. 1). This is particularly advantageous when the containment/exclusion boom is utilized in adverse wave and current conditions and ballast 32 alone may not be sufficient to maintain the boom 10 in place or the curtain 14 in a substantially vertical orientation. The anchor(s) can be temporarily installed anchors or permanent anchors. When such anchors are utilized it is also desirable to stabilize the upper end of the curtain member 14 (or sleeve 16) using cables or wires 44 (also shown in FIG. 1). For booms of considerable length, anchors preferably are attached at regular intervals.

When anchors are employed, their location may be marked by brightly colored buoys, as necessary.

The containment/exclusion boom 10 of the present invention can also include at least two tow cords and secured to the main sheet portion 20. The tow cords are used to tow the boom into position or from one location to another. The two cords can be bands or strips of nylon lifting straps, steel or aluminum cable, polypropylene rope, geosynthetic material, or the like that extend the length of the curtain member 14 and can be secured to the main sheet portion 20. One tow cord can be secured at or adjacent to the upper sleeve 16 and a second tow cord can be secured to one or both of the skirts on the Y-panel member 22. Tow cords of this type are disclosed in U.S. Pat. No. 5,102,261 to Gunderson, which is hereby incorporated by reference in its entirety. Depending on the overall length of the containment/exclusion boom 10 and other design parameters, additional tow cords may be positioned on the main sheet portion as necessary.

The upper curtain member 14 is formed of a flexible fabric material that allows the flow of water therethrough. One class of preferred materials are known as geosynthetic fabrics, which are formed of geotextile material(s). The geosynthetic fabric is "hydrophobic" or "water-pervious," meaning that water passes through the fabric. The hydrophobic property of geosynthetic fabric permits the passage of water current through the main body portion of the upper curtain member 14, thereby maintaining the relative shape and position of the boom even in adverse current conditions. It also facilitates towing of the boom.

Typically, the geosynthetic fabric will be "oleophilic," meaning that it absorbs or attracts oil, thereby blocking the flow of oil. For containment of silt and other suspended particulates, it is not essential that the curtain be oleophilic; obviously, for containment of oil, the curtain preferably is oleophilic.

Useful geosynthetic fabrics are further characterized by high load distribution capacity, the ability to abate material filtration, and permeability to water. Geosynthetic fabrics are commercially available in a range of tensile strengths, permeabilities, and permitivities, and are useful for the purposes of the invention throughout those ranges.

Geosynthetic fabric may be prepared using one or a combination of various polymers, for example polyester, polypropylene, polyamides, and polyethylene. Most commercially available geosynthetic fabrics are polypropylene or polyester. Examples of suitable nonwoven geosynthetic fabrics include, but are not limited to, AMOPAVE® 4399, AMOPAVE® HD 4597, 4545, 4553, and 4561 (all polypropylene fabrics commercially available from Amoco Fabrics and Fibers Company); Typar®, a polypropylene fabric commercially available from Dupont; TREVIRA® Spunbond, a polyester fabric commercially available from Hoechst Fibers Industries. Examples of suitable woven geosynthetic fabrics include, but are not limited to, 1380 SILT STOP®, 1198, 1199, 2090, 2000, 2006 (all polypropylene fabrics commercially available from Amoco Fabrics and Fibers Company).

One of ordinary skill in the art is readily able to select appropriate geosynthetic fabrics to meet project-specific design requirements without undue experimentation.

The geosynthetic fabrics are nonbiodegradable, so they do not deteriorate due to environmental exposure. During prolonged use, exposure to ultraviolet (UV) light may cause some geosynthetic fabrics to weaken or deteriorate. However, UV-resistant fabrics are commercially available as well as UV resistance treatment methods.

For most applications, it is sufficient to construct the upper curtain member 14 with a single layer of geosynthetic fabric. However, for some applications, a multilayer construction may be desirable to provide added strength or protection against abrasion. The layers could be of the same geosynthetic fabric or different fabrics. For instance, a curtain might have a first layer of nonwoven fabric and a second layer of a woven fabric, which would tend to be more abrasive-resistant than the nonwoven fabric. The fabric can optionally be custom designed to provide for greater or lesser water flow therethrough, as described in U.S. patent application Ser. No. 09/168,491 to Gunderson et al., which is hereby incorporated by reference in its entirety.

Depending upon the environmental, tidal, wave and current conditions, anticipated load requirements, and other parameters, the appropriate geosynthetic fabric, tow cord, ballast, and flotation unit can be selected to meet the specific design requirements for a given spill event or other inclusion/exclusion project.

Other relevant parameters for the containment/exclusion boom 10 include, but are not limited to, water depth, particulate size, length of time the boom is to be in place, pollutant composition, and the availability of manpower and equipment.

The Y-panel member 22 (including the skirts 23,23' and connector panel 24) can also be formed of a material which allows the flow of water therethrough, including any of the various types of geosynthetic materials described above. The Y-panel member 22 can be formed of the same geosynthetic material used to form the upper curtain member 14 or different geosynthetic materials.

Alternatively, the Y-panel member 22 can be formed of a flexible material that resists the movement of water therethrough. Polymer coated fabrics, including geosynthetic materials, can be coated so as to minimize the porosity thereof, which increases their resistance against the flow of water. By way of example, a rubberized canvas or geosynthetic material can be used.

Sewing or heat fusion of the geosynthetic material can be used to form the sleeves of the upper curtain member 14 and Y-panel skirts 23,23', to attach Y-panel skirts 23,23' to one another and/or to the upper curtain member 14, to connect multiple sheets together to add additional height (i.e., increase the vertical dimension of the upper curtain member 14), to attach any straps or tow cords, or to effect any other connection of fabric materials as disclosed herein. The geosynthetic fabric can be sewn with a conventional industrial sewing machine, and heat fusion can be accomplished with an industrial iron. Heat fusion can also be accomplished by puncturing or piercing through the overlapped geosynthetic fabric with a soldering iron or heated needles. Good, strong connections have been made this way. Zipper connections can also be used to connect the different sections, panels, skirts, etc., including connection of flotation and ballast sleeves. This use of zipper connections is disclosed in U.S. Provisional Patent Application Ser. No. 60/328,757 to Dreyer, filed Oct. 11, 2001, which is hereby incorporated by reference in its entirety.

A series of containment/exclusion booms 10 constructed according to the present invention can be joined together to form booms of longer longitudinal length. For this purpose, the upper curtain member 14 and Y-panel member 22 extend longitudinally beyond the end of the flotation unit 12 to define an end portion at each end of the boom. With this construction, two curtains can be positioned such that the end portions thereof overlap. The overlapping end portions can be sewn or heat sealed together. For quicker on-site connections, a coupler device may be used. A particularly suitable coupler device is a pair of industrial hook-and-loop fastening strips, such as the Dual-Lock Systems (polyolefin) commercially available from the Minnesota, Mining and Manufacturing Company. Mating hook-and-loop fastening strips are secured to the end portions of the two endwise adjacent upper curtain member 14 and Y-panel member 22 that are to be connected together, with the strips of one curtain positioned to coincide with mating strips of the other curtain. Other alternative mechanical means can be used to form the connection, including zipper assemblies. The final step in joining the two booms is to bring the tow cords of one curtain together with the tow cords of the other curtain and secure the tow cords together using carabinier, shackles, or other appropriate mechanical connecting means. Such a connection allows for uniform load distribution along the tow cords.

The support system can be either a temporary support system which floats (as described above) or a permanent or semi-permanent support system.

The temporary, floating support system is preferably formed of a plurality of flotation units which provide sufficient buoyancy to keep the boom afloat and to maintain freeboard. Conventional flotation units usable with the present invention include inflatable devices, air bags, and floats made from buoyant materials, such as cork, synthetic foams, and other plastics. However, conventional devices may not perform adequately under adverse conditions. It has been found that under adverse conditions, expanded polystyrene ("EPS") is especially suitable for use as the flotation unit. It is desirable to coat or seal the EPS to prevent deterioration associated with prolonged exposure to the elements. EPS is commercially available from ARCO Chemical Company as DYLITE® and can be formed or molded into flotation units of various sizes and shapes (e.g., cylindrical, square, etc.) as required by project design. The EPS has a positive buoyancy that keeps the flotation unit above the water surface at all times, allowing the flotation unit to ride the waves, even in adverse conditions. An EPS flotation unit is not deformed by wave action and does not lose buoyancy if punctured, as would an inflatable device. A single cubic foot of EPS can support as much as 60 lbs (27.2 kg). A commonly used size of flotation unit of EPS is about 12 inches (30.5 cm) in diameter, but the size can be readily adapted to meet specific wave and environmental conditions and depth requirements.

The permanent or semi-permanent support system can be used as an alternative to the floating support system afforded by use of the EPS or other buoyant materials. Such support systems can include pilings of conventional construction and horizontal support members (i.e., a wire, beam, catwalk, or other like support) which extend between adjacent pilings. The upper curtain member 14 can be connected to either the horizontal support members or both the horizontal support members and the pilings. The Y-panel member 22 can similarly be attached to the pilings. These alternative support systems are described in U.S. patent application Ser. No. 09/168,491, which is hereby incorporated by reference in its entirety.

Figure 2:
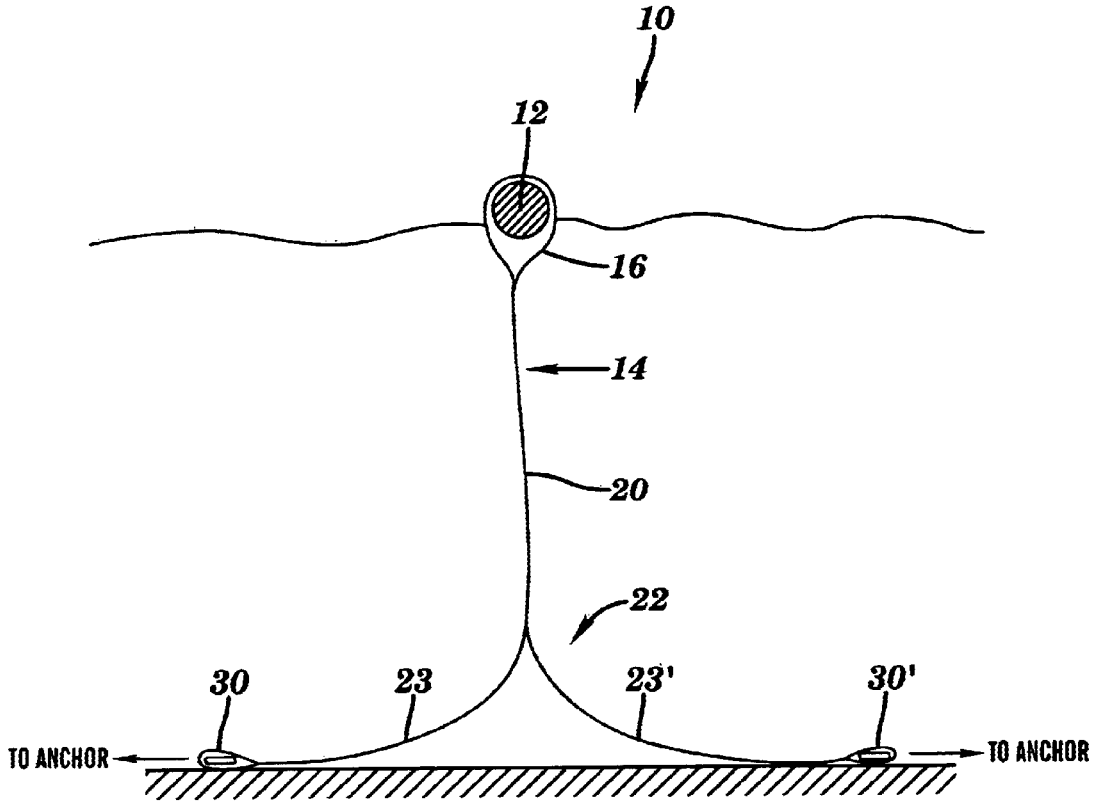
FIG. 2 is a side elevational view of a boom of the present invention which is installed in a body of water under no current flow.
Figure 3:
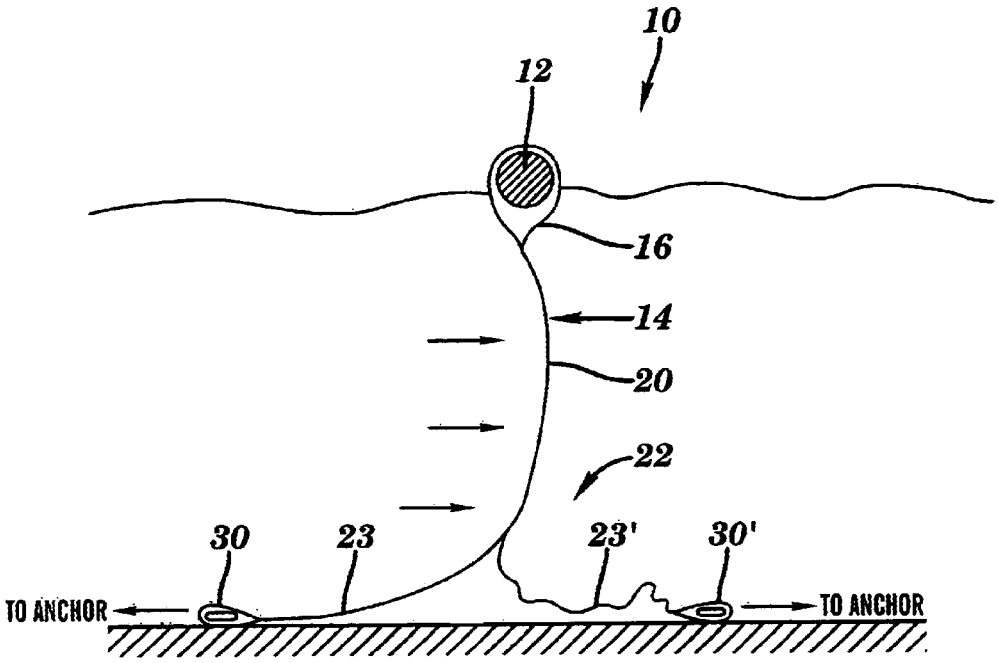
FIG. 3 is a side elevational view of a boom of the present invention which is installed in a body of water under current flow in one direction.
Figure 4:
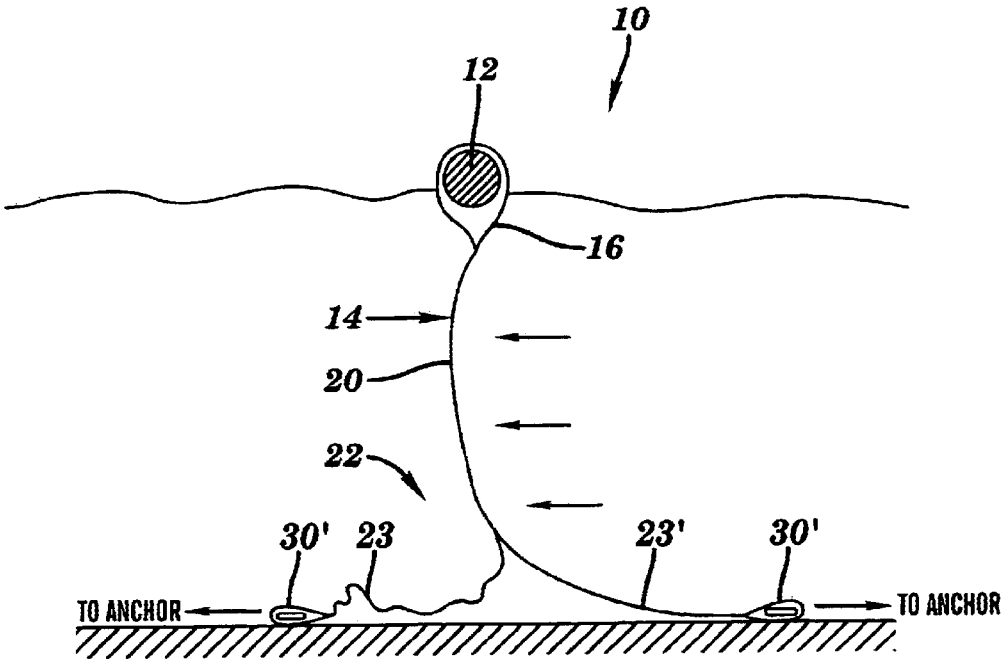
FIG. 4 is a side elevational view of a boom of the present invention which is installed in a body of water under current flow in a direction opposite from that shown in FIG. 3.

When a containment/exclusion boom 10 of the present invention is installed into a body of water, it is particularly useful to contain or exclude contaminants from passage from one side to another side of the boom. It is believed that the improvement in containment or exclusion of contaminants is due to the presence of the Y-panel member 22 and, in particular, due to the arrangement of the first and second skirts 23,23' which are maintained against the floor of the body of water in which the boom resides. As shown in FIG. 2, when there is little or no current flow through the curtain 14, both of the skirts 23,23' are sufficiently positioned against the floor of the body of water. In comparison, as shown in FIGS. 3 and 4, the Y-panel member 22 can accommodate changes in current flow. The stress applied to the curtain 14 by the current flow has the effect of sealing the upstream skirt sufficiently against the floor of the body of water while the downstream side contains slack. This scenario is maintained regardless of the direction of flow. In either case, as the upstream skirt makes contact with the floor of the body of water, friction between the floor and the skirt increases to provide resistance against the movement of that upstream skirt. It is believed that this friction enhances the seal to further insure that contaminants cannot pass by the boom.

In addition, as the water flow changes direction, silt or other fouling material impinged against the prior upstream side of the curtain will be cleaned off of that side when the water begins to flow in the opposite direction (i.e., when the fouled material is then located on the downstream side).

In addition to the foregoing use, the containment/exclusion boom 10 of the present invention finds itself available to numerous uses which have been described in the art. These include, without limitation, containment of spills and releases; as a littoral flow trap or basin to prevent deterioration of beaches or shoreline along rivers, lakes, oceans, etc.; and as a bathing beach pollution and debris barrier screen to define a swim area.

Although the invention has been described in detail for the purpose of illustration, it is understood that such detail is solely for that purpose, and variations can be made therein by those skilled in the art without departing from the spirit and scope of the invention which is defined by the following claims.

What is claimed:

1. A containment/exclusion boom comprising:

a support system which can be positioned in a body of water;

an upper curtain member made of a flexible fabric that allows movement of water therethrough, said upper curtain member being connected to said support system;

a Y-panel member integral with or connected to said upper curtain member, said Y-panel member comprising a first skirt panel and a second skirt panel each having a proximal end adjacent the upper curtain member and each having a distal end; and means for maintaining the distal end of the first and second skirt panels substantially against the floor of a body of water upon introduction of the containment/exclusion boom into the body of water.

2. The containment/exclusion boom of claim 1 wherein the support system comprises a flotation unit.

3. The containment/exclusion boom of claim 1 wherein the means for maintaining comprises:

first and second ballast secured, respectively, to the distal ends of the first and second skirt panels.

4. The containment/exclusion boom of claim 3 wherein the means for maintaining further comprises:

first and second anchors secured, respectively, to the distal ends of the first and second skirt panels.

5. The containment/exclusion boom of claim 1 wherein the means for maintaining comprises:

first and second anchors secured, respectively, to the distal ends of the first and second skirt panels.

6. The containment/exclusion boom of claim 1 wherein the upper curtain member is formed of a geosynthetic fabric.

7. The containment/exclusion boom of claim 1 wherein the Y-panel member is formed of a flexible fabric that allows movement of water therethrough.

8. The containment/exclusion boom of claim 7 wherein the Y-panel member is formed of a geosynthetic fabric.

9. The containment/exclusion boom of claim 1 wherein the Y-panel member is formed of a flexible material that resists movement of water therethrough.

10. The containment/exclusion boom of claim 9 wherein the Y-panel member is formed of a rubberized canvas.

11. The containment/exclusion boom of claim 1 wherein the Y-panel member is connected to a lower edge of said upper curtain member.

12. A method of containing/excluding contaminants from passage from one side to another side of a boom comprising:

installing a boom according to claim 9 into a body of water with the first skirt panel being positioned substantially on one side of the upper curtain member and the second skirt panel being positioned substantially on the other side of the upper curtain member, wherein one or both of the first and second skirt panels are maintained substantially against the floor of the body of water, thereby containing or excluding contaminants from passage from one side to another side of the boom.

* * * * *